US005237343A

United States Patent [19]

Osada

[11] Patent Number: 5,237,343

[45] Date of Patent: Aug. 17, 1993

[54] INK JET HEAD SUBSTRATE, INK JET HEAD HAVING SAME AND MANUFACTURING METHOD FOR INK JET HEAD

[75] Inventor: Torachika Osada, Kawasaki, Japan

[73] Assignee: Canon Kabushiki Kaisha, Tokyo, Japan

[21] Appl. No.: 849,809

[22] Filed: Mar. 11, 1992

Related U.S. Application Data

[63] Continuation of Ser. No. 497,614, Mar. 23, 1990, abandoned.

[30] Foreign Application Priority Data

Mar. 24, 1989 [JP] Japan ..... 1-72183
Jan. 12, 1990 [JP] Japan ..... 2-3479

[51] Int. Cl.[5] ..... B41J 2/05; B41J 2/16
[52] U.S. Cl. ..... 346/140 R
[58] Field of Search ..... 346/140 R

[56] References Cited

U.S. PATENT DOCUMENTS 4,207,579 6/1980 Gamblin et al. ..... 346/75
4,313,124 1/1982 Hara ..... 346/1.1
4,345,262 8/1982 Shirato et al. ..... 346/1.1
4,459,600 7/1984 Sato et al. ..... 346/1.1
4,463,359 7/1984 Ayata et al. ..... 346/1.1
4,558,333 12/1985 Sugitani et al. ..... 346/140 R
4,716,421 12/1987 Ozawa et al. ..... 346/140 R
4,723,129 2/1988 Endo et al. ..... 346/1.1
4,740,796 4/1988 Endo et al. ..... 346/1.1
4,740,800 4/1988 Kyoshima ..... 346/140
4,812,859 3/1989 Chan et al. ..... 346/140
4,947,114 8/1990 Schindlbeck ..... 324/158 R

FOREIGN PATENT DOCUMENTS 59-123670 7/1984 Japan .
59-138461 8/1984 Japan .

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

An ink jet recording head substrate includes a supporting member supporting a plurality of electrothermal transducers having heat generating resistors and electrodes electrically connected to the heat generating resistors; and identification marks for easy identification of each of the electrothermal transducers.

18 Claims, 16 Drawing Sheets

INK JET HEAD SUBSTRATE, INK JET HEAD HAVING SAME AND MANUFACTURING METHOD FOR INK JET HEAD

This application is a continuation of application Ser. No. 07/497,614 filed Mar. 23, 1990, now abandoned.

FIELD OF THE INVENTION AND RELATED ART

The present invention relates to an ink jet recording head substrate, an ink jet recording head having the same and a manufacturing method for the ink jet recording head.

A recording head used in an ink jet recording system generally comprises a plurality of fine ejection outlets (orifices) for ejecting ink, ink passages communicating with the orifices, a common chamber for supplying ink to the respective ink passages and ejection energy generating elements disposed correspond to the ink passages.

In order to dispose the orifices, and particularly a great number of orifices with high positional precision, the following known manufacturing method can be used, for example. The number of grooves for constituting the ink passages are formed on a substrate with a photosensitive resin. Another substrate (top plate) is bonded on the groove-formed surface to provide the ink passages, by which the number of orifices are disposed with good positional precision.

It is known to provide means on the substrate for permitting the display of identification of each of the energy generating elements (electrothermal transducer) in order to facilitate quality control and observation of the change after inspection and repair during the manufacturing step or after the manufacturing of the ink jet recording head substrate and the ink jet recording head using the substrate wherein a number (particularly a great number) of electrothermal transducers are disposed on a supporting member, corresponding to orifices.

For example, as shown in FIG. 1, reference electrodes having a cut corner 3-1 are provided at regular intervals (every 16 electrodes, in FIG. 1), by which each of the electrothermal transducers can be identified.

As another method, as shown in FIG. 2, numericals giving representative identification numbers (reference numbers) are written at predetermined positions during a photolithographic process.

However, the method shown in FIG. 1 involves a problem that when a great number of electrothermal transducers are disposed at a high density, it is not easy to correctly and quickly know the place of a reference number electrode, so that the correct inspection is not possible in a short time.

The method shown in FIG. 2 involves the problem that there is a limit to the reduction of the size of the numerical, and therefore, it is not suitable to the electrothermal transducers disposed with a high density.

When, for example, the heat generating resistors are disposed at a density higher than 400 dpi (dots per inch), and when the numerals are reduced correspondingly, the numerals are not easily read when they are observed by the operator's eyes through an enlarging optical system or when they are automatically read using a CCD (charge coupled device) camera, an optical microscope and a computer.

The recording head manufactured through the processes described above may be inspected after the manufacturing at the orifice and the portions therearound to inspect the ink ejection or the like.

The inspection is carried out for each of the orifices. If some trouble is discovered, the ejection energy generating element corresponding to the orifice is energized to eject the ink, and the ink ejection and the ink dot deposited on the recording medium are inspected further in detail. In addition, the orifice having trouble is identified, so that the operator can take appropriate measures, as the case may be.

When the orifice is identified in the observation thereof, there are following problems.

In the observation of the orifices, they are counted from one end, and therefore, the orifice may be erroneously identified. In addition, it takes a long time to identify it, with the result that the cost for the inspection process is increased.

SUMMARY OF THE INVENTION

Accordingly, it is an object of the present invention to provide an ink jet recording head substrate and an ink jet recording head using the substrate, which has marks representing identification numbers for the electrothermal transducers which can be easily formed with a reduced area occupied thereby and which can be easily read during the observation by human eyes through an enlarged optical system or during an automatic inspection.

It is another object of the present invention to provide an ink jet recording head and a manufacturing method therefor wherein a mark is provided on an ejection surface where the ejection outlets are aligned for each of a predetermined number of ejection outlets, by which any one of the ejection outlets can be easily identified, and wherein the mark is formed during the recording head manufacturing process, by which method the marks can be formed correctly at positions not interfering with the ink ejection, for example.

According to an aspect of the present invention, there is provided an ink jet recording head substrate, comprising: a supporting member for supporting a plurality of electrothermal transducers having heat generating resistors and electrodes electrically connected to the heat generating resistors; and identification marks for easy identification of each of the electrothermal transducers.

According to another aspect of the present invention, there is provided an ink jet recording head having a plurality of ejection outlets for ejecting ink therethrough; and marks on an ejection side wherein the plural ejection outlets are disposed for each of a predetermined number of ejection outlets.

According to a further aspect of the present invention, there is provided a method of manufacturing an ink jet recording head including plural ejection outlets for ejecting ink to perform recording, comprising: a step of forming an ejection side surface at which the ejection outlets are formed; the step including formation of predetermined marks on the ejection side surface.

The identification mark used in this embodiment indicates the number by dot arrangement in a predetermined area, and therefore is easily formed in a small area, and in addition, is easily read by observation and automatic inspection. The identification mark can be easily formed at the correct position by a simple process step change, for example, by adding a pattern for the formation of the identification mark to the exposure pattern when the pattern is formed using photolithography for the electrode and the heat generating resistor constituting the electrothermal transducer, for example.

However, the material for forming the identification mark and the method for the formation are not limited to the above, and various methods are usable.

When the identification mark is formed using an electrode layer and a heat generating resistance layer, it will suffice if the materials of such layers have different refractive indexes.

According to an aspect of the present invention, the marks are provided for every predetermined number of ejection outlets on the ejection surface where the plural ejection outlets are aligned, by which the position of the ejection outlet can be counted on the basis of the mark, so that the ejection outlet can be identified easily.

By forming the mark during the manufacturing process for the ink passages and the ink ejection outlets in the recording head manufacturing process, the positional relation with the ejection outlet can be correct, and in addition, the ink ejection is not influenced by the provision of the marks.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The preferred embodiments of the present invention will be described in conjunction with the accompanying drawings.

EMBODIMENT 1

Figure 1:
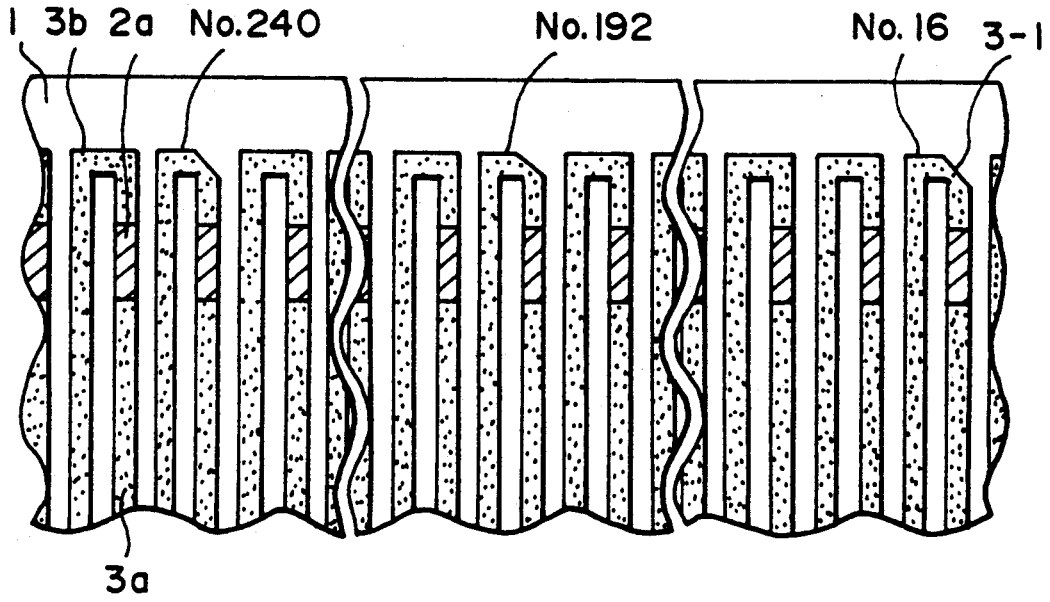
FIG. 1 PRIOR ART
FIGS. 1 and 2 are top plan views of conventional substrates in the background art.
Figure 2:
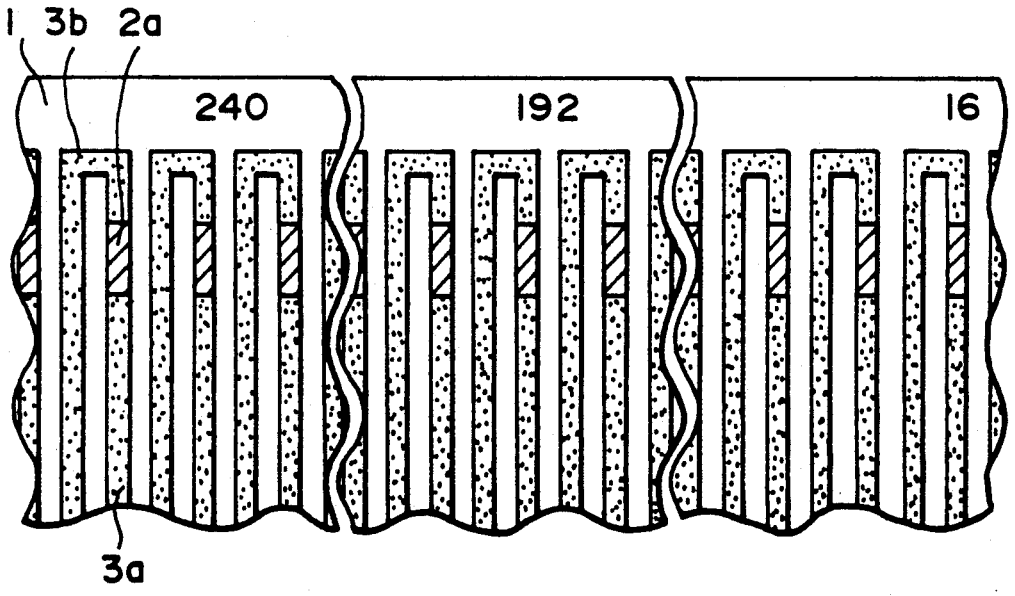
FIG. 2 PRIOR ART
Figure 3:
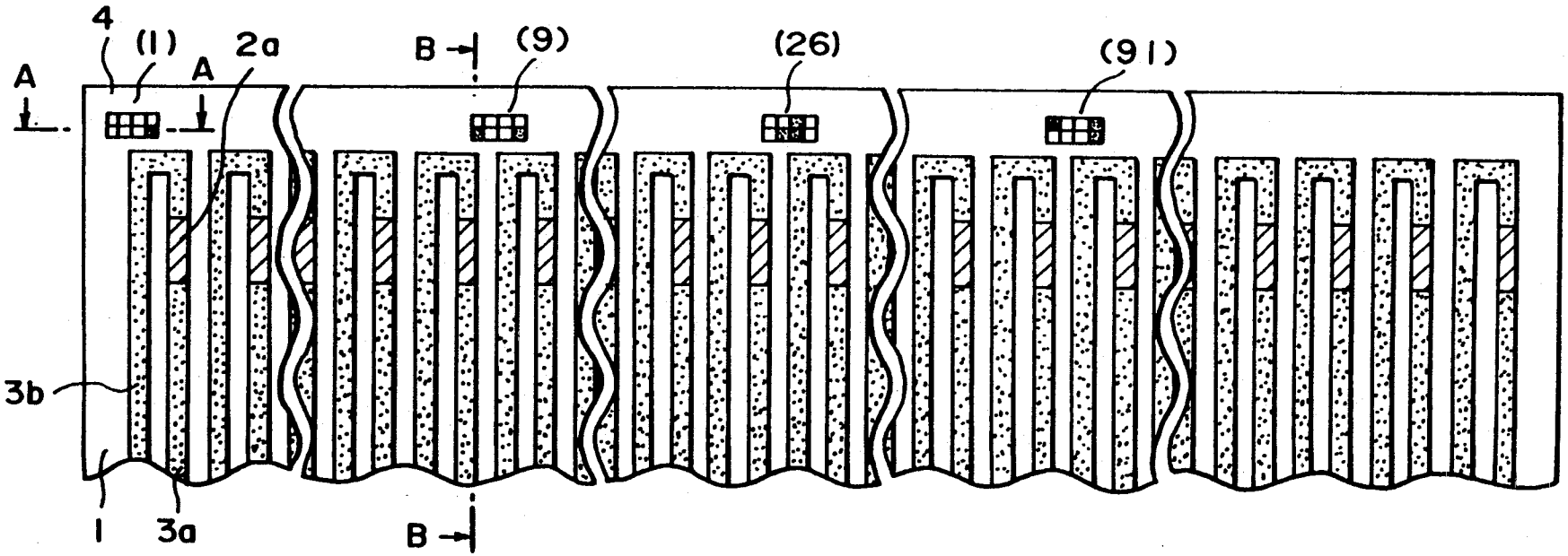
FIG. 3 is a top plan view of a major part of the ink jet recording head substrate according to an embodiment of the present invention
Figure 4A:
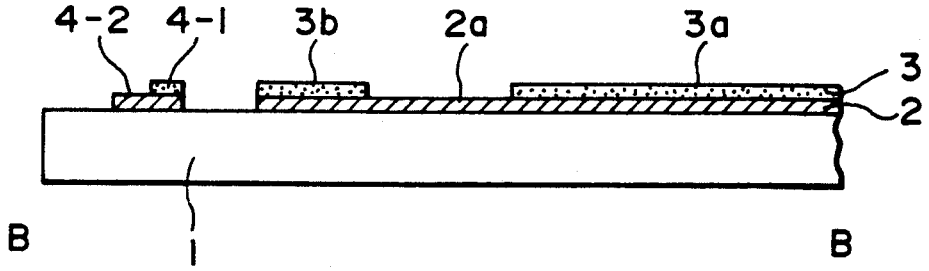
FIG. 4A is a part sectional view taken along a line B—B of FIG. 3.
Figure 4B:
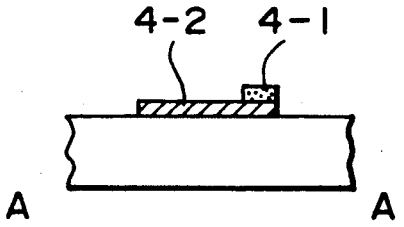
FIG. 4B is a part sectional view taken along a line A—A of FIG. 3.

As shown in FIGS. 3, 4A and 4B, the ink jet recording head substrates in this embodiment includes a supporting member 1, on which a great number of electrothermal transducers are disposed at a desired density. Each of the electrothermal transducers includes a heat generating resistor 2*a* and electrodes 3*a* and 3*b* electrically connected to the heat generating resistor 2*a*, wherein the heat generating resistor 2*a* is constituted by a heat generating resistor layer 2 between electrode layers to constitute a heat generating portion for generating heat in response to the application of electrical power. Identification marks 4 representing identification numbers are formed above (adjacent one side of the substrate) for representative electrothermal transducers.

As shown in FIGS. 4A and 4B, the identification mark 4 is constituted by projection dots 4-1 provided by the electrode layer on the lower layer 4-2 constituting the heat generating resistance layer, correspondingly to the identification number.

Since the heat generating resistance layer and the electrode layer have different refractive indexes, the dots 4-1 are discriminated on the lower layer 4-2.

As shown in FIGS. 5A–5F, the top line of the identification mark 4 as seen from the above (the line (5)) represents the number of tens, and the bottom line (the line (6)) represents the number of units. The columns (1)–(4) represents the number in the binary system, wherein the digit increases from (1) column to (4) column. The presence of the dot 4-1 in the columns (1)–(4) represents "1" in the binary system, whereas the absence thereof represents "0" in the binary system.

Figure 5A:
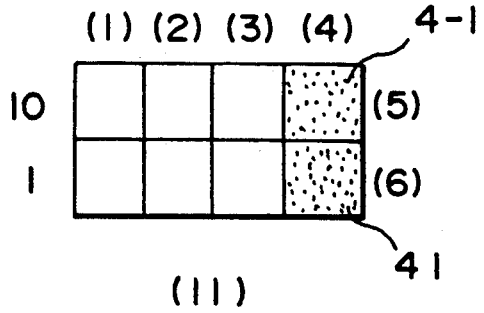
FIGS. 5A–5F are top plan views of an example of an identification mark.

For example, the identification mark in FIG. 5A represents "0001" in the units, and "0001" in the tens, and therefore, it represents "11" in the decimal system.

Figure 5B:
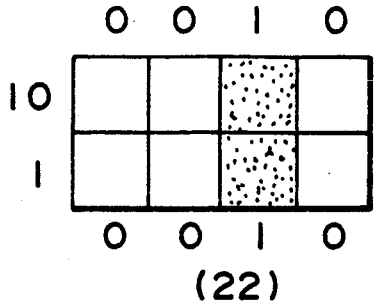
Figure 5C:
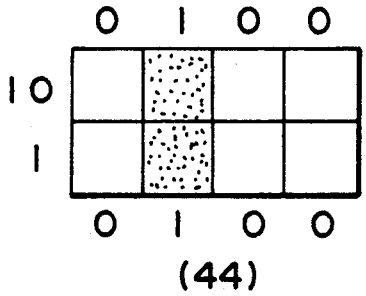
Figure 5D:
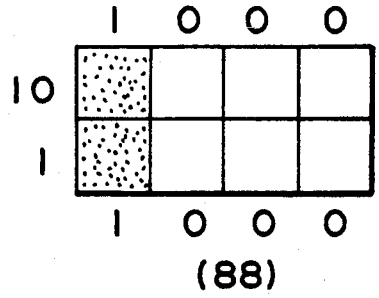
Figure 5E:
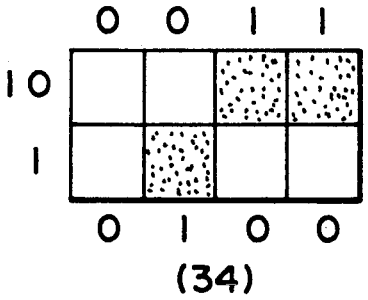
Figure 5F:
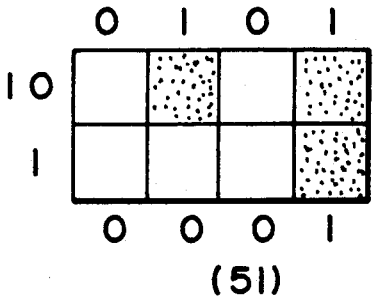

In the identification mark of FIG. 5B, the number of units is "0010" in the binary system, and the number of tens is "0010" in the binary system, and therefore, it represents "22" in the decimal system.

Similarly, FIGS. 5C–5F represent "44", "88", "34" and "51", respectively.

The identification mark 4 can be formed when the electrothermal transducers are formed by patterning the heat generating resistor layer and the electrode layer laminated on the supporting member 1. This is done by allowing the proper portions of the layers on the supporting member to remain as a predetermined configuration such as three-dimensional configuration of the lower layer 4-2 and as the dots 4-1 at the predetermined positions on the lower layer.

When the heat generating resistor layer and the electrode layer are patterned using a photolithographic process, the identification marks can be formed simultaneously with the formation of the electrothermal transducer simply adding the identification mark forming pattern into the exposure mask.

The supporting member 1, the heat generating resistor 2A and the electrodes 3A and 3B may be made of material ordinarily used for such purposes.

The configuration of the identification mark 4, more particularly, the configurations of the dots 4-1 and the lower layer 4-2 are not limited to those illustrated in the Figures, but may be in various forms. For example, the dot 4-1 may be in the form of a circle or the like.

Figure 6A:
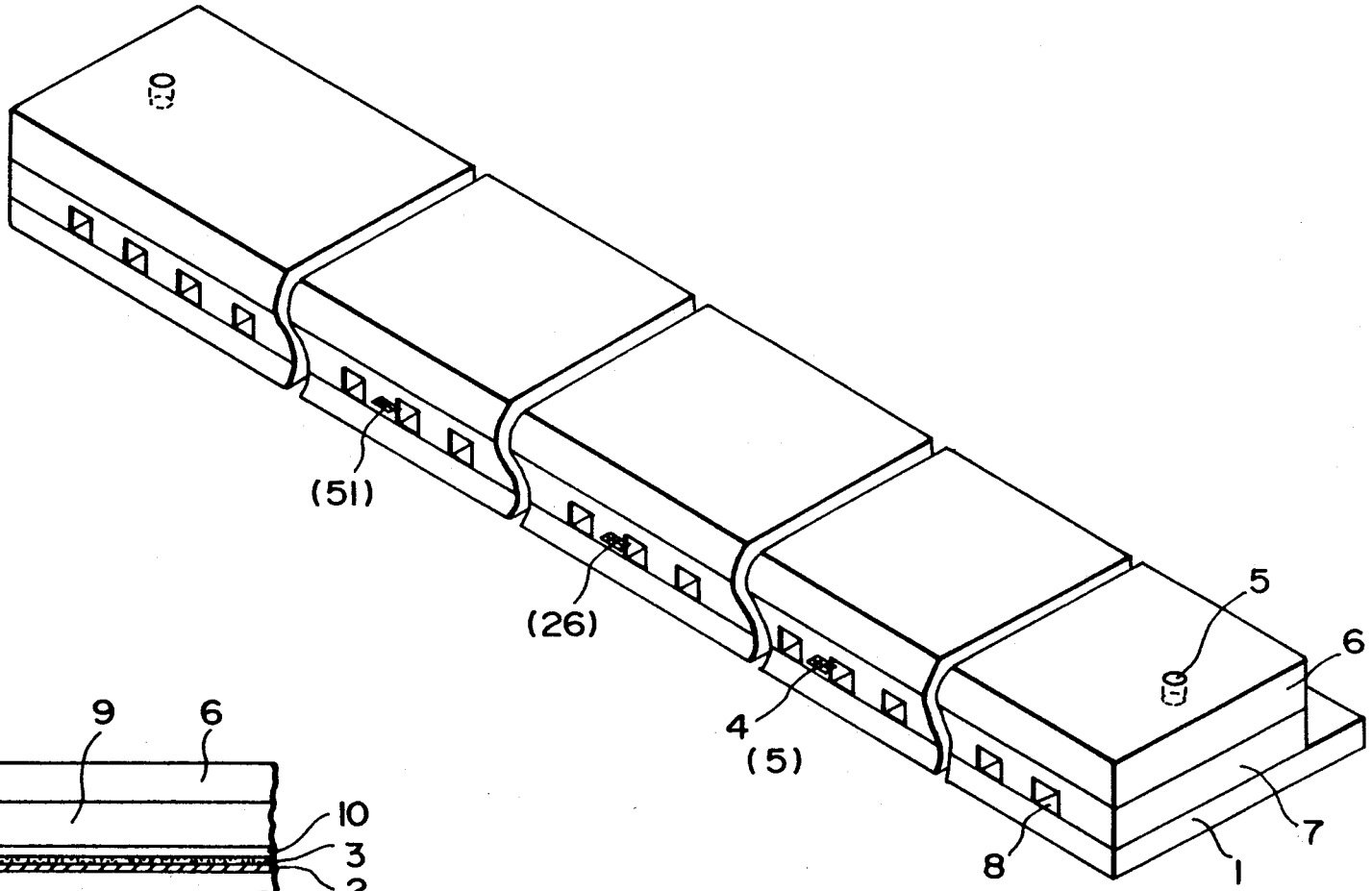
FIG. 6A is a perspective view of an ink jet recording head including the substrate of FIG. 3.
Figure 6B:
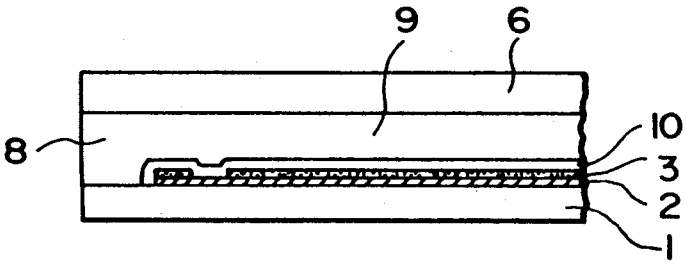
FIG. 6B is a part sectional view taken along an ink passage of the recording head of FIG. 6A.
Figure 7:
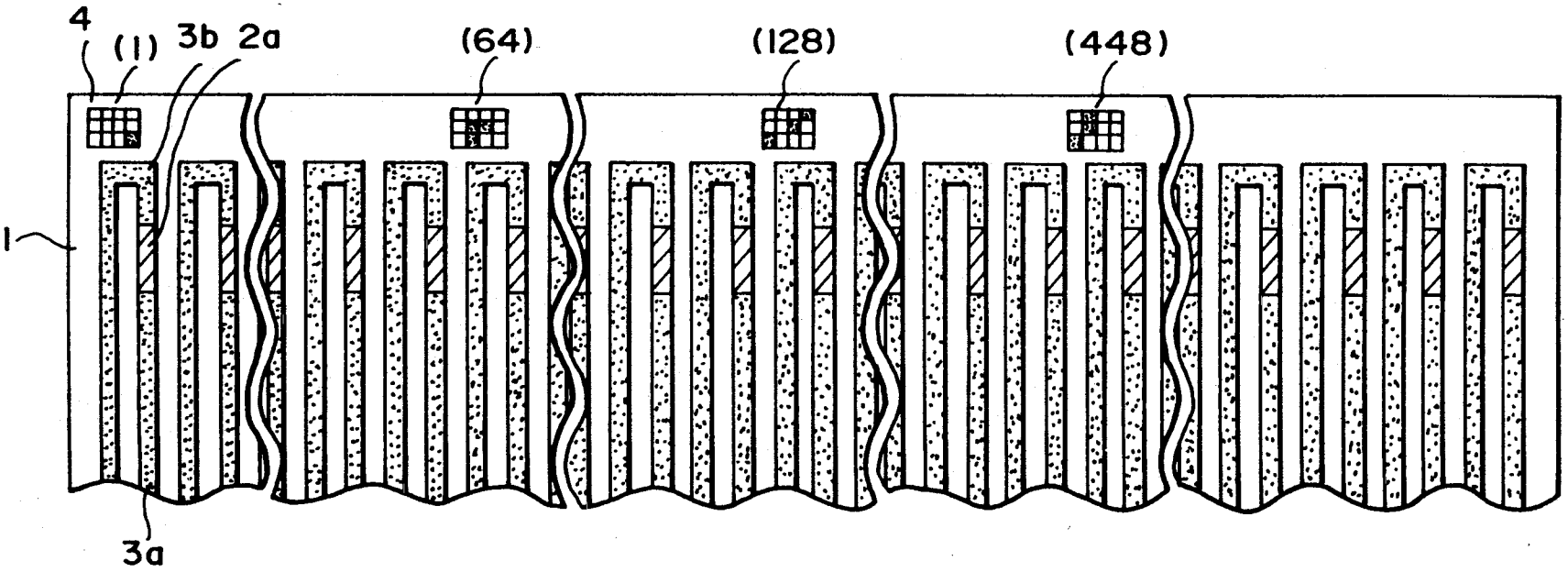
FIGS. 7 and 9 are top plan views illustrating another example of arrangements of the identification marks.
Figure 8A:
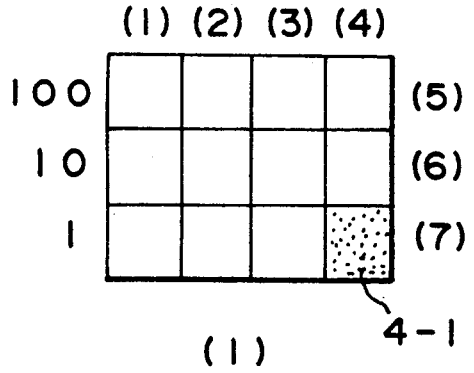
FIGS. 8A–8F and FIGS. 10A–10D are top plan views of other examples of the identification marks.
Figure 8B:
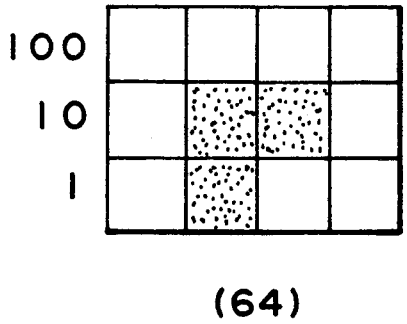
Figure 8C:
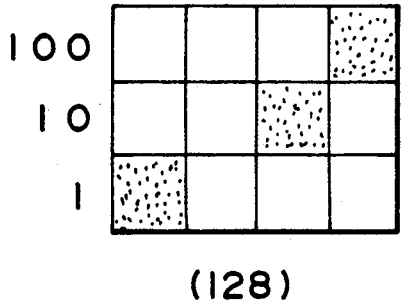
Figure 8D:
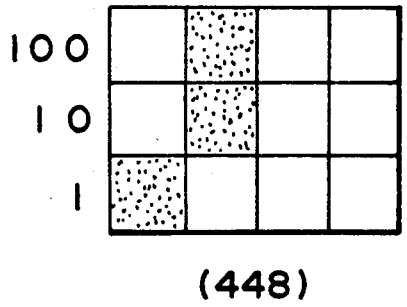
Figure 8E:
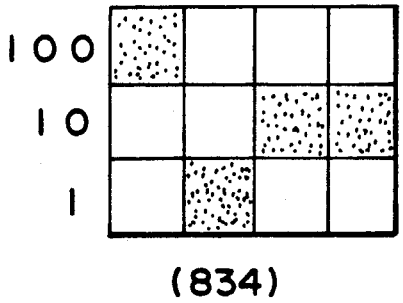
Figure 8F:
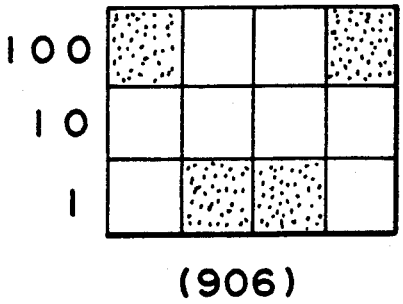

On the substrate having the structure described above, ink passages and ejection outlets or the like are formed corresponding to the heat generating resistors 2a through a usual method which will be described hereinafter, by which an ink jet recording head having the structure shown in FIGS. 6A and 6B, for example, can be provided.

The materials of various parts of the ink jet recording head may be those ordinarily used.

By the provision of the identification marks described above, the correct identification number of each of the electrothermal transducer can be known quickly without difficulty during the inspection after the power supply test for the substrate or during the inspection after the printing test for the ink jet recording head.

An ink jet recording head having the structure shown in FIGS. 6A and 6B has actually been manufactured through the process which will be described hereinafter. The identification number has easily been known for each of the electrothermal transducers by observation through metallurgical methods or through a stereoscopic microscope into the ink passage 9 from the ejection outlet 8 side.

The substrate 1 is a silicon plate having a surface layer of $SiO_2$ provided by heat oxidation (layer thickness is 2.75 microns). On the supporting member 1, an $HfB_2$ layer having a layer thickness of 0.13 micron is formed as the heat generating resistor layer by bias sputtering, and on the $HfB_2$ layer, an Al layer having a layer thickness of 0.55 micron is laminated as the electrode layer 3 by the bias sputtering.

By the patterning process using the photolithographic technique, the electrode 3a and 3b (line width of 26 microns), the heat generating resistor layer 2a (100 microns×20 microns with a pitch of 63.5 microns) and identification marks 4 (14 microns×28 microns of the lower layer 4-2 and 7 microns×7 microns of the dot 4-1) are formed by allowing the layers on the supporting member 1 to remain in the configuration shown in FIGS. 3, 4A and 4B.

At least on those portions of the electrodes 3a and 3b and the heat generating resistor 2a which will be right below the ink passage or the ink chamber, a protection layer of $SiO_2$ having a thickness of 1.9 microns by bias sputtering is provided.

Using the photolithographic process, the walls constituting the ink passages 9 and the ink chamber (not shown) is formed by a cured layer of epoxy resin. A top plate 6 is bonded thereto to provide the ink jet recording head having the structure shown in FIGS. 6A and 6B.

EMBODIMENT 2

As shown in FIGS. 7, 8A–8F, three digit decimal numbers can be represented by adding a line (5) representing the number of hundreds. It will be understood that FIGS. 8A–8F represent "1", "64", "128", "448", "834" and "906". It will be understood that larger numbers can be represented by increasing the number of lines for the dots 4-1.

EMBODIMENT 3

The identification mark shown in FIGS. 9, 10A–10D is constituted by two mark elements each having two lines, thus providing in total four lines to represents the numbers of hundreds. As will be understood, FIGS. 10A–10D represent "1", "822" "1280" and "4736".

Figure 9:
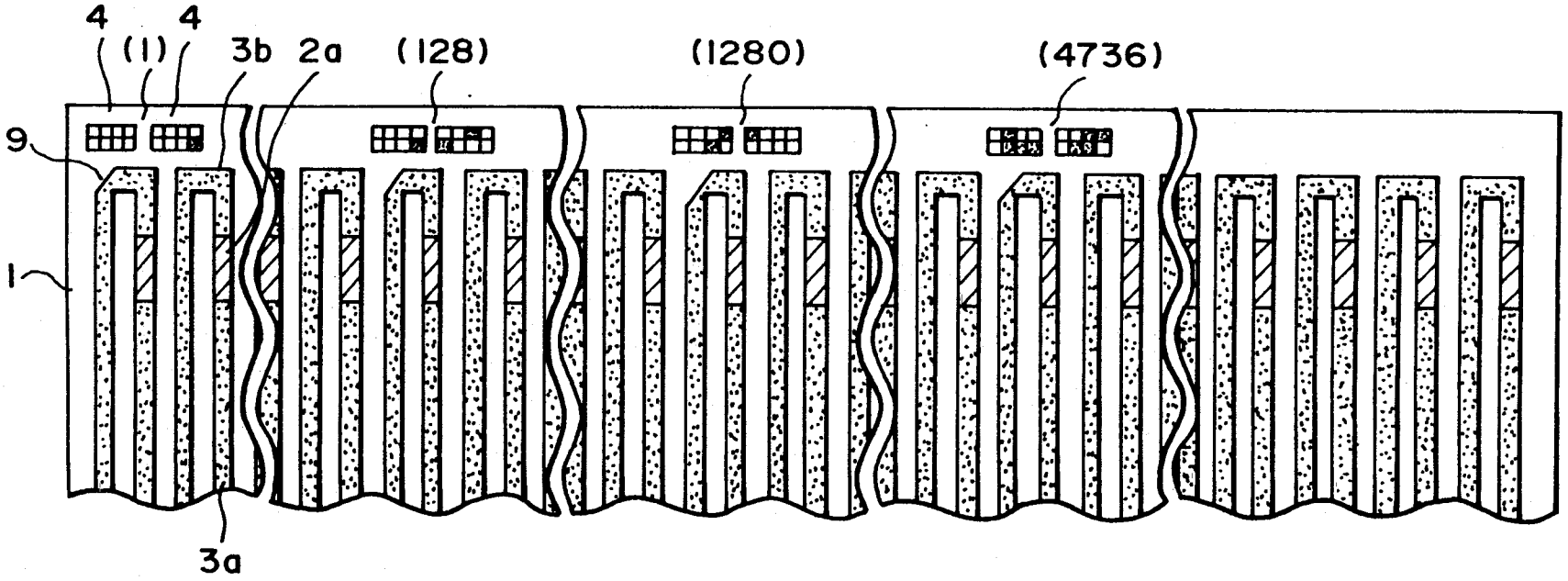
Figure 10A:
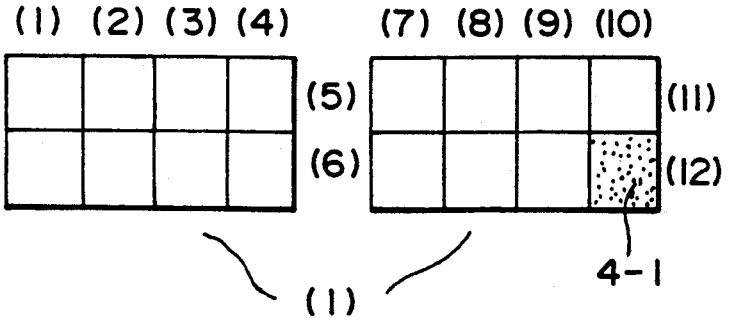
Figure 10B:
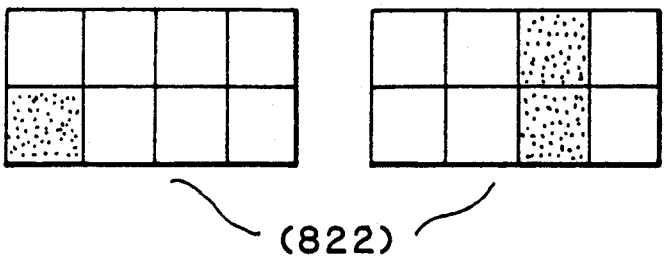
Figure 10C:
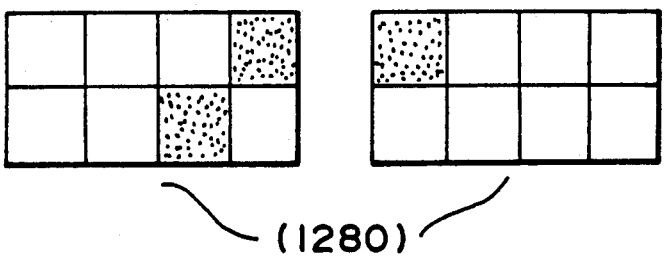
Figure 10D:
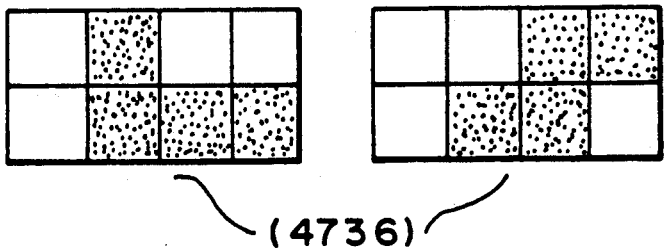

When the identification mark shown in FIG. 9 is used, the two identification marks may be formed over a plurality of electrothermal transducers, depending on the density of the electrothermal transducers. In this case, by cutting a corner of the electrode to provide the pattern 11, it can be made clear which electrothermal transducer corresponds to the identification mark.

EMBODIMENT 4

Figure 11:
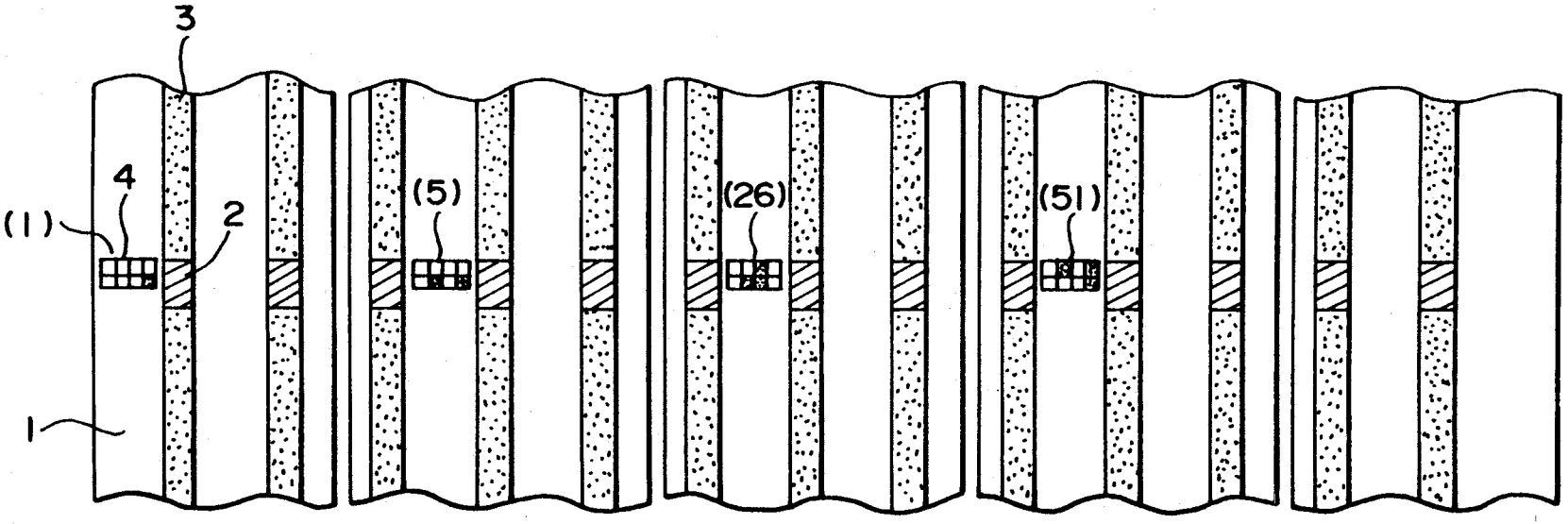
FIG. 11 is a top plan view illustrating another example of the identification mark arrangement.

In the foregoing embodiments 1–3, the direction in which the ink is supplied in the ink passage to the position corresponding to the heat generating resistor is substantially the same as the direction in which the ink is ejected through the ejection outlet. If the directions are different, for example, if the directions form right angles, the identification mark 4 may be disposed at a position shown in FIG. 11, for example.

EMBODIMENT 5

Figure 12:
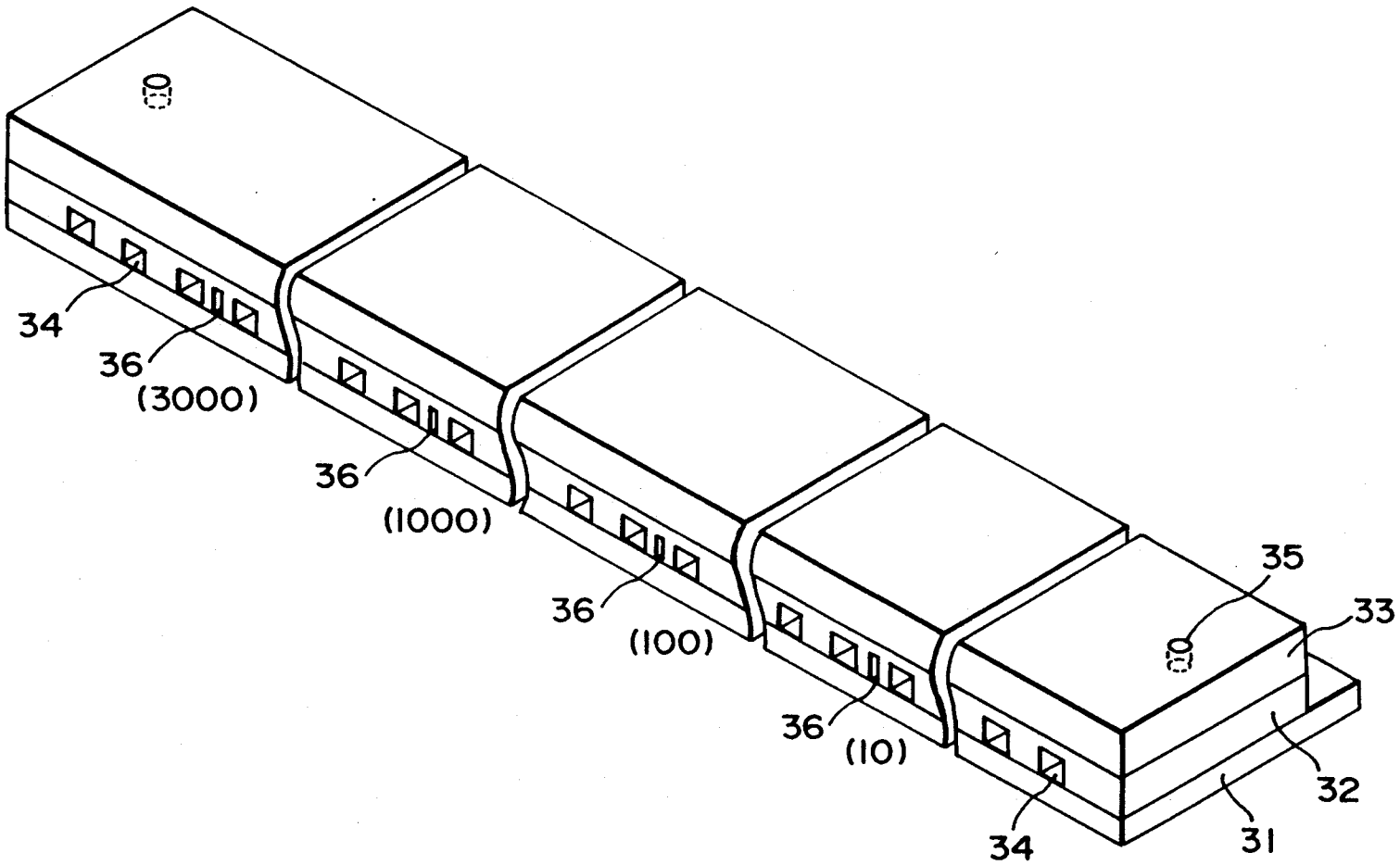
FIG. 12 is a perspective view of an ink jet recording head according to another embodiment of the present invention.

Referring to FIG. 12, a further embodiment will be described. FIG. 12 is a perspective view of an ink jet recording head of a so-called full line type manufactured by a manufacturing method according to an embodiment of the present invention. The recording head is provided with not less than 3000 orifices through which ink is ejected to perform the recording.

A substrate 31 is provided with electrothermal transducer elements for producing energy for ejecting the ink and function elements or the like for driving the electrothermal transducer element. The substrate is made of a silicon wafer. Designated by a reference numeral 32 is a layer of material curable by active energy radiation which will constitute ink passages. A top plate 33 is made of glass. Ejection or discharging outlets (orifices) 34 are effective to form ink droplets. An ink supply port 35 functions to supply Grooves 36 are formed at a pitch of 10 orifices. The grooves function as orifice identification marks. By counting the orifices on the basis of the mark, an orifice can be identified by smaller number of counting operations.

Figure 13A:
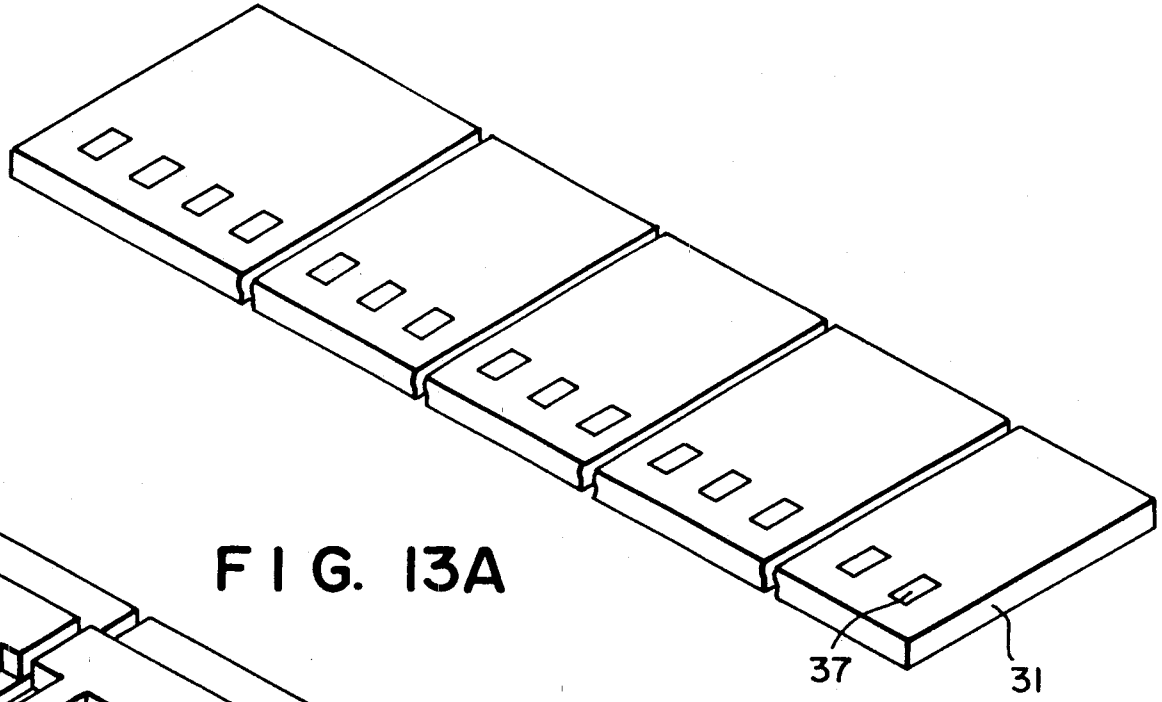
FIGS. 13A–13E are perspective views illustrating an example of ink jet recording heads.

FIGS. 13A–13E are perspective views illustrating various manufacturing steps for manufacturing the ink jet recording head of FIG. 12, according to an embodiment of the present invention. Referring to this figure, the manufacturing method for the recording head will be described FIG. 13A illustrates the substrate provided with the ejection energy generating elements 37. The ejection energy generating elements 37 are disposed at the portions corresponding to the portions at which the ink passages will be formed. As the material for the substrate 31, glass silicon wafer or the like are usable. As for the ejection energy generating element 37, a piezoelectric element or a heat generating element may be used, for example. In this embodiment, the substrate is made of silicon wafer, and the element 37 is an electrothermal transducer element.

The substrate 31 is provided with function elements and electrode wiring (not shown) for driving the electrothermal transducer element 37.

Figure 13B:
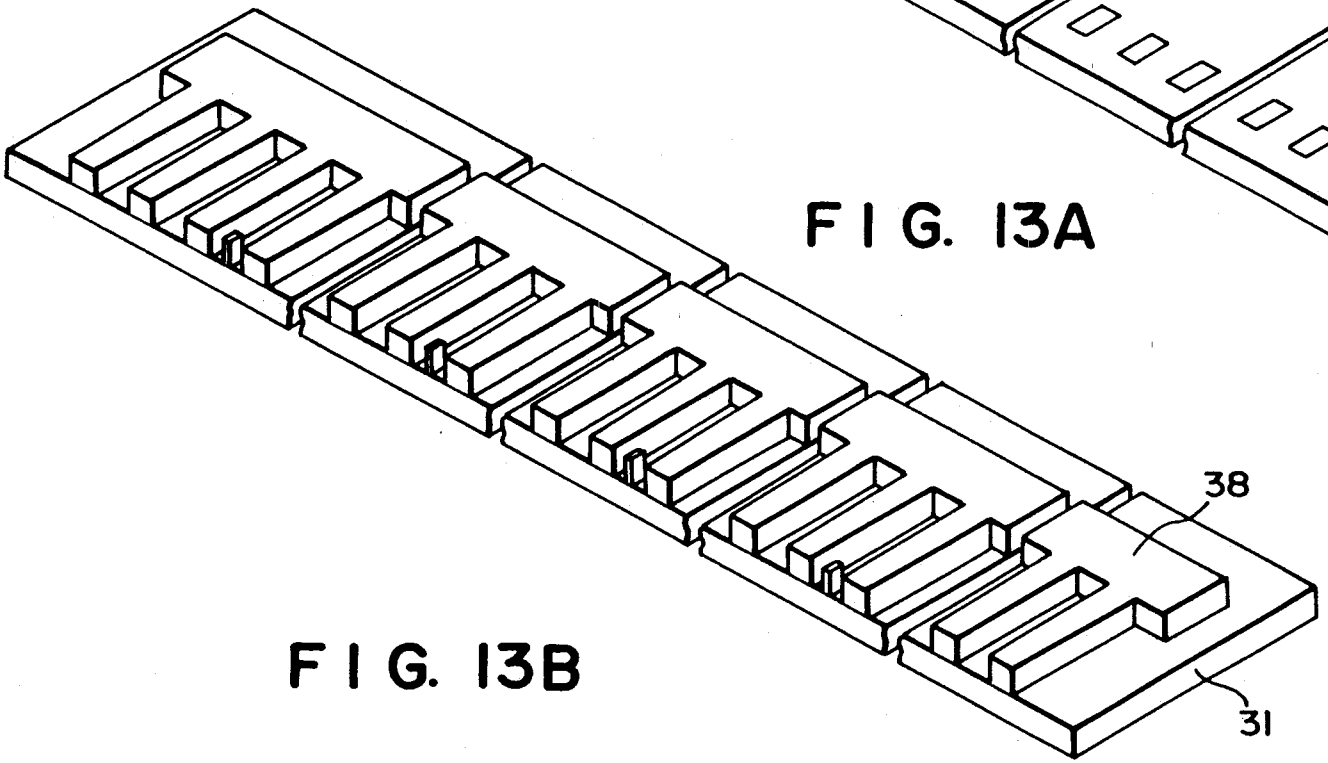

As shown in FIG. 13B, a dissolvable and removable solid layer 38 is formed on the substrate 31 in the pattern of the liquid passages and in pattern corresponding to the common liquid chamber communicating with all the liquid passages and in the pattern of grooves adjacent to the orifices for each of 10 orifices.

The material of the solid layer 38 is of a positive type photoresist material containing as major components naphthoquinonediazide derivative and orthocrezolenovolak resin or a positive type dry film photoresist material.

The pattern of the solid layer 38 is formed b the photolithographic technology, for example, to a thickness of 20–100 microns with the passage width of 20–100 microns. The material of the solid layer 38 will suffice if it can be dissolved and removed by solvent after the formation of the pattern. The other chemical properties of this material are not limited. The positive chemical reaction may be of any type. The formation of the solid layer 38 at the portions corresponding to the common chamber is not inevitable. The formation thereof may be selected depending on the heads and the subsequent processing steps.

Figure 13C:
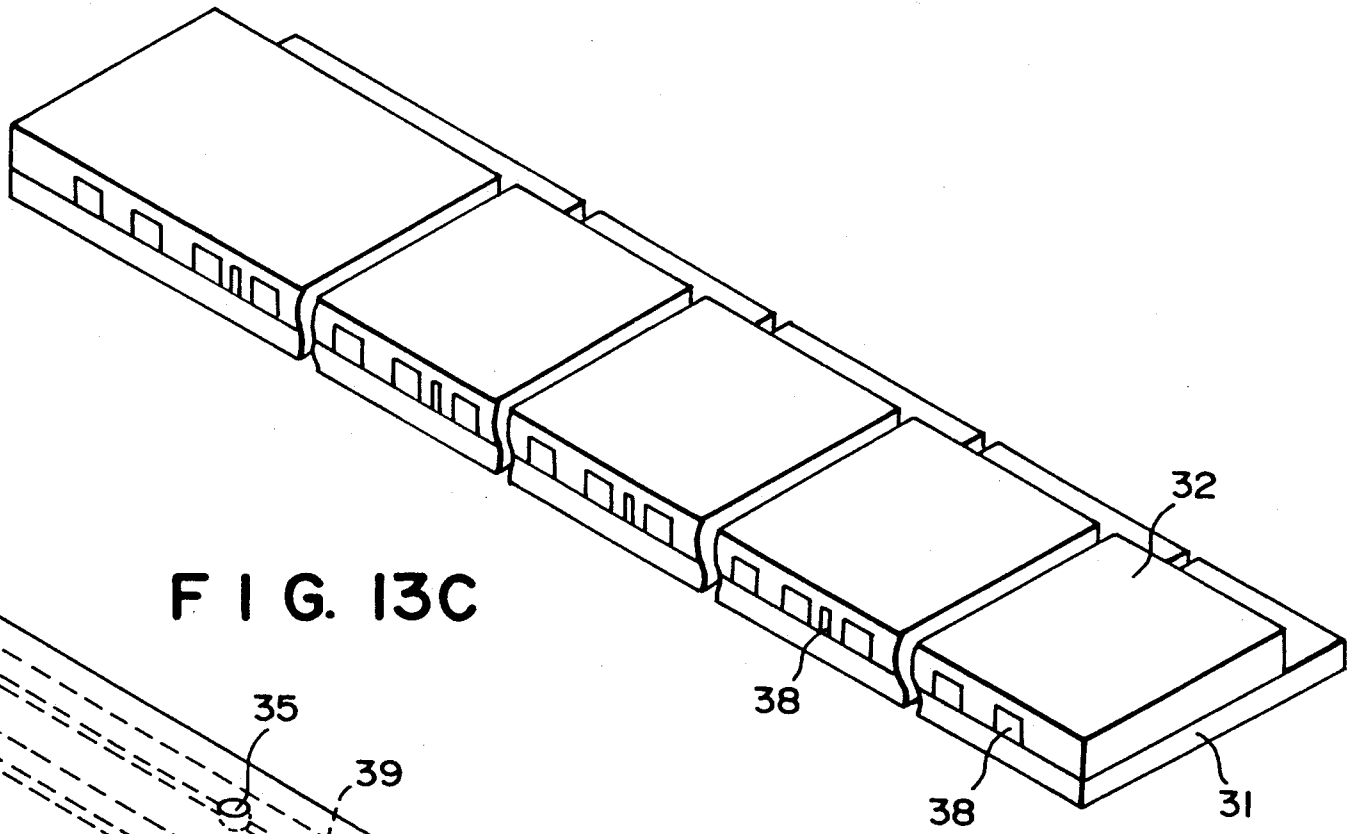

As shown in FIG. 13C, the side 31 having the solid layer 38 is coated with a material 32 curable by active energy radiation. The material 32 constitutes the walls of the liquid passages, and therefore, it is preferable that the material exhibits good bonding property with the substrate, sufficient mechanical strength and good chemical resistance. The curable material 32 does not easily dissolve the solid layer 38 when it is applied on the solid layer 38.

Figure 13D:
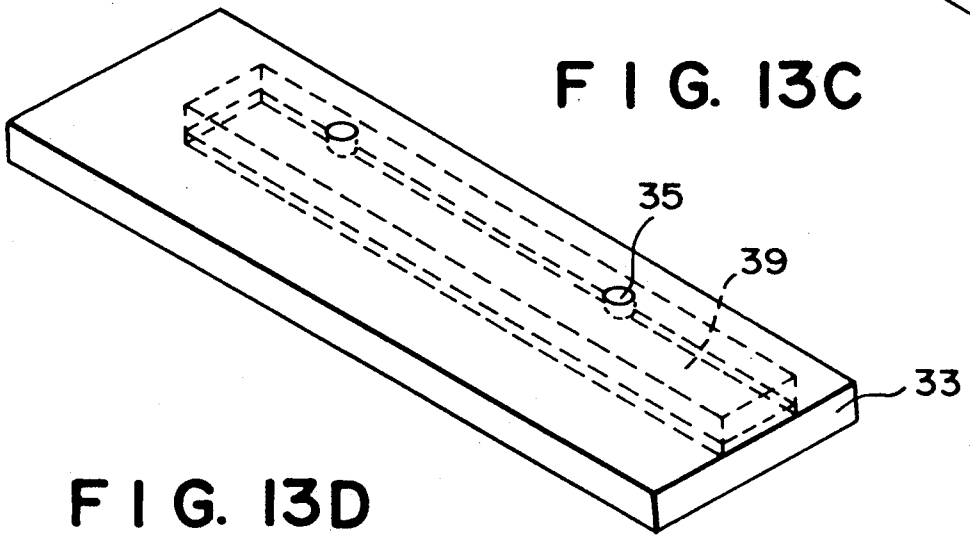

FIG. 13D is a perspective view of a top plate having a recess 39 which will constitute the common chamber. On the top side of the top plate 33, an ink supply port 35 is formed. The material of the top plate 33 may be, for example, metal, glass, plastic resin, ceramic material or the like. The recess 39 and the ink supply port 35 may be formed through a process suitable for the material selected.

Figure 13E:
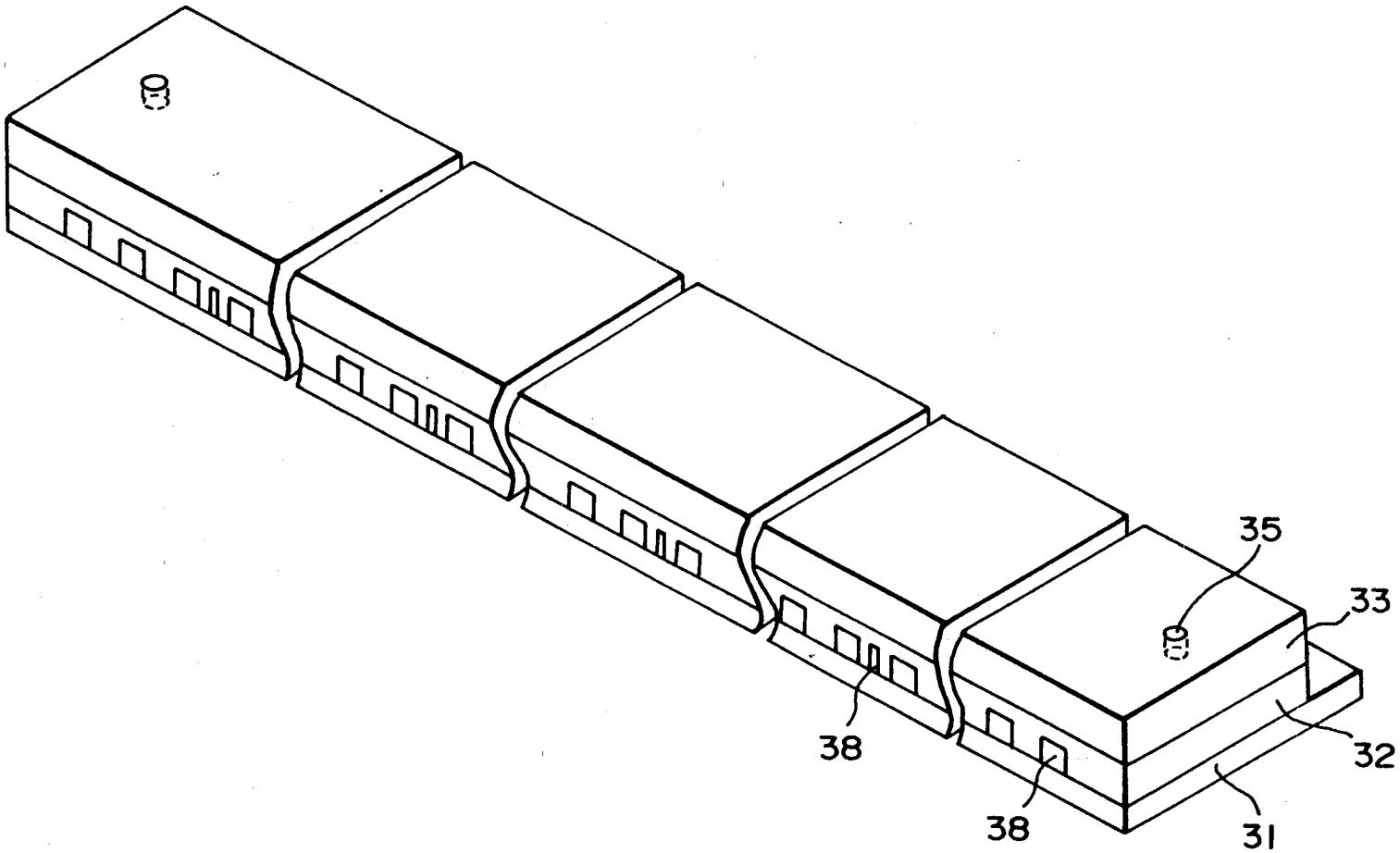

Subsequently, as shown in FIG. 13E, the top side of the curable material 32 shown in FIG. 13C is bonded with the top plate 33 shown in FIG. 13D. Thereafter, the portions which will constitute the common liquid chamber are masked, and the active energy radiation is applied thereto. After the application, it is developed with developing liquid.

In the bonding, it is preferable that the surfaces bonded together is not warped, but it is not inevitably necessary that the surfaces are smooth. They may be physically or chemically treated for an improvement in the bonding property therebetween.

Then, the side of the bonded assembly in which the orifices are formed is cut, abraded to provide a correct predetermined distance between the ejection energy generating elements 37 and the orifices 35. The side is finished into a smooth orifice surface (ejection surface). Next, a metallizing treatment or the like, such as ink repelling treatment or metal evaporation is performed. When the abrading or other processing is carried out, the passages and grooves for each of ten orifices are filled with the solid layer 38, and therefore, the abrading or other processes do not influence the internal walls of the liquid passage. If necessary or desired, the other portions may be cut. If not necessary, the abrading and the other processing may not be performed. For the cutting operations, a precision cutting device for manufacturing semiconductor devices is preferably used.

In order to provide the grooves or slot for each of ten orifices and the liquid passages, the filling solid layer 38 is dissolved and removed, and the inside is cleaned. In this manner, the liquid passages are formed and the grooves are formed in the orifice surface.

In the dissolving, removing and the cleaning steps for the solid layer 38, it is dipped in an organic solvent in a ultrasonic wave cleaning bath, by which the processing can be completed quickly.

The above-described abrading step, the other treating step and the solid layer 38 dissolving and removing step may be performed before the top plate 33 is bonded. By the method described in the foregoing according to the present invention, an ink jet recording head shown in FIG. 12 may be provided.

EMBODIMENT 6

Figure 14:
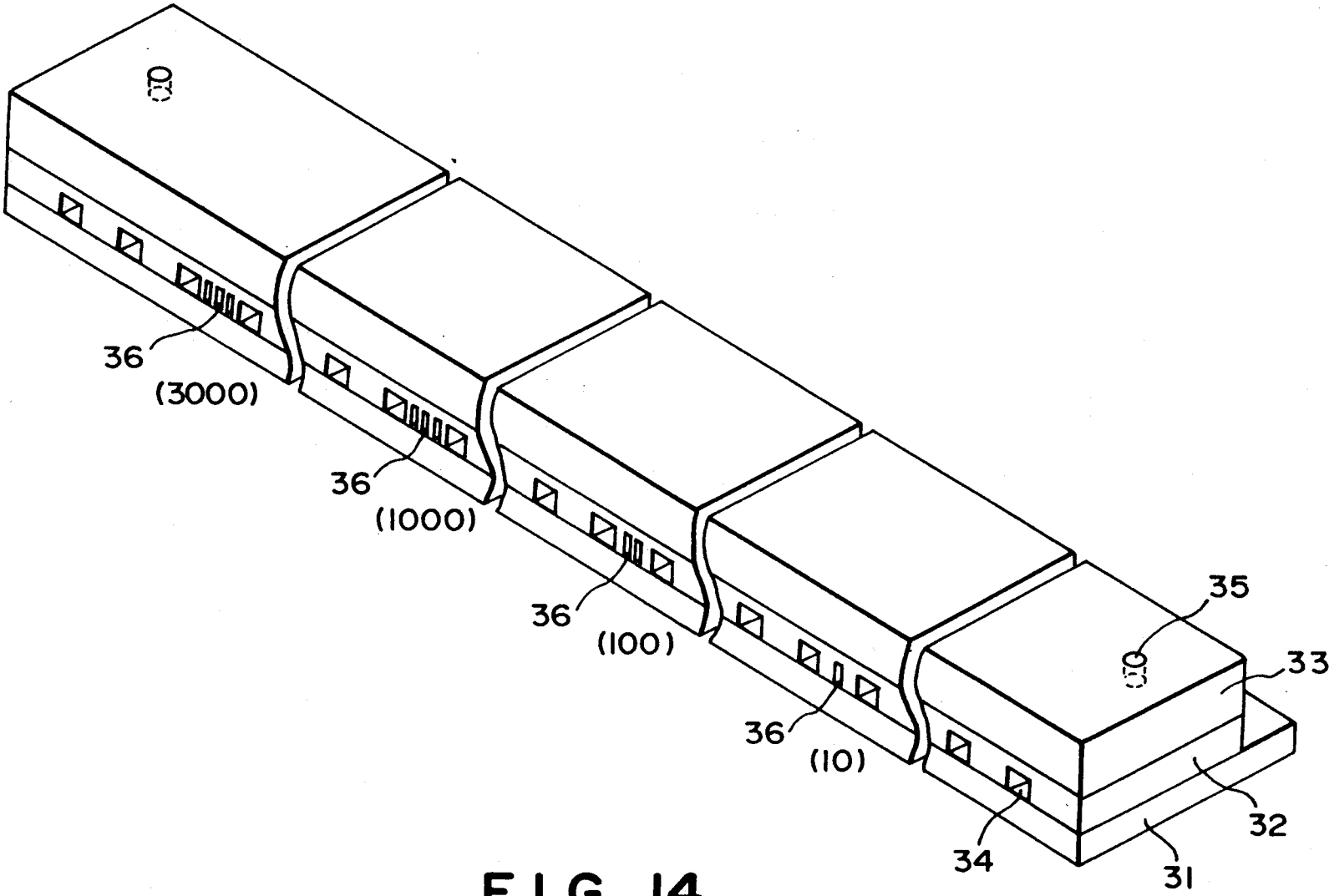
FIG. 14 is a perspective view of an ink jet recording head according to a further embodiment of the present invention.

FIG. 14 is a perspective view of a full line type recording head manufactured by the manufacturing method described in the foregoing embodiment.

In this embodiment, the numbers of the grooves 36 for each 10 orifices, for each 100 orifices and for each 1000 orifices are different to facilitate identification of an orifice. By this, the orifice can be identified quickly.

According to this embodiment, the correct identification number of each of the electrothermal transducer may be determined by an observer's eyes quickly using an identification mark representing the identification of the electrothermal transducers, which can be easily read.

The discrimination of the identification number can be carried out automatically if a binary representation, a CCD camera, an optical microscope or a computer or the like which constitute an automatic reading device, are used.

Accordingly, the efficiency of the identification of the electrothermal transducers during various inspections can be increased.

The identification mark according to this embodiment can be made at the same time as and by the same material as the electrothermal transducers. In addition, the area occupied by the identification mark can be very easily reduced, as compared with the case where figures are written. Therefore, it can meet the high density requirements of the thermal electrotransducers.

In addition, according to another aspect of the present invention, a mark in the form of a groove or grooves is provided for each predetermined number of ejection outlets on the ejection orifice surface where the plural ejection outlets are disposed, by which the position of an ejection outlet may be counted on the basis of the mark, so that an ejection outlet can be identified.

In addition, by forming the mark during the manufacturing process for forming the ink ejection outlets and the ink liquid in the recording head manufacturing process, the positional relation with the ejection outlet can be made correct, and the ink ejection is not adversely affected by the provision of the marks.

Accordingly, an ejection outlet can be identified quickly during the ejection outlet inspecting operation, for example. Therefore, the time required for the inspection can be reduced.

Figure 15:
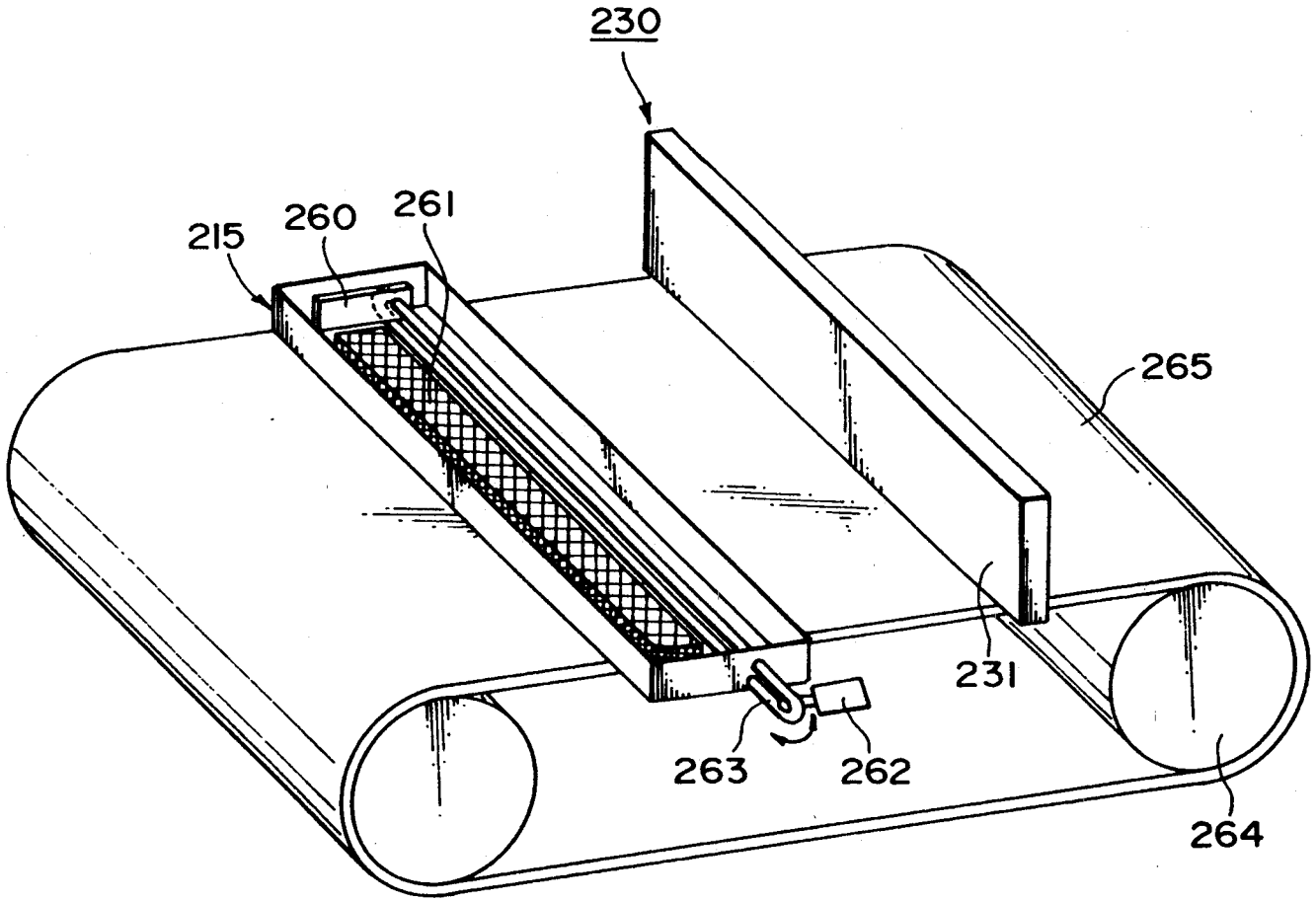
FIG. 15 is a schematic perspective view illustrating a major part of an ink jet apparatus provided with the ink jet recording head according to the present invention.

FIG. 15 is a somewhat schematic perspective view of an ink jet recording apparatus provided with the ink jet recording head according to an embodiment of the present invention. In FIG. 15, the apparatus includes the ink jet recording head 230. In the ejection surface 231 of the ink jet head 230, ejection outlets (not shown) are formed over the entire width of the recording region for a recording material (not shown). In this example, the ink is ejected downwardly through the ejection outlets. The recording material is supplied to the conveyer belt 265 by unshown means, and is conveyed by the movement of the conveyer belt 265 driven by the conveying roller 264.

The apparatus further comprises an ejection recovery system 215, and an ink absorbing material 261. To the absorbing material 261, the ink is ejected by the ink jet head 232 (preliminary ejection), and therefore, ejection trouble is prevented. A blade 260 is effective to wipe the ejection side surface 231 of the head. In order for the blade 260 to continuously wipe the plural ejection outlets in the ejection side surface 231, it is driven by a motor 262 along the guide shaft 263.

The present invention is particularly suitable to an ink jet recording head of a type wherein electrothermal transducers generating thermal energy for the ejection of the ink are provided for plural ejection outlets (for example, not less than 1000 outlets and further not less than 2000 outlets) covering the entire recording region for the recording material. The reason for this is that with the increase of the number of the electrothermal transducers and the ejection outlets, the tendency for the problems to arise that were described in conjunction with the background art increases.

The present invention provides excellent effects particularly in a recording head, and in a recording device of a bubble jet recording system among the ink jet recording systems.

As to the ink ejection principle, the one disclosed in U.S. Pat. Nos. 4,723,129 and 4,740,796 is preferred. This system is applicable to either of the so-called on-demand type and the continuous type. Particularly, the on-demand type is preferable because in that type, by applying at least one driving signal which gives a rapid temperature rise exceeding the nuclear boiling point, corresponding to the recording information supplied to the electrothermal transducers arranged corresponding to the sheets or the liquid passages containing liquid (ink), heat energy is generated by the electrothermal transducers to produce film boiling at the heating surface of the recording head, and consequently a bubble is formed in the liquid (ink), corresponding to each of the driving signals.

By ejecting or discharging the liquid (ink) through an opening for discharging by growth and shrinkage of the bubble at least one droplet is formed. By making the driving signals into pulse shapes, growth and shrinkage of the bubble can be effected instantaneously adequately to accomplish preferable discharging of the liquid (ink) particularly excellent in response characteristics. As the driving signals of such pulse shape, those as disclosed in U.S. Nos. 4,463,359 and 4,345,262 are suitable. Further excellent recording can be performed by employment of the conditions disclosed in U.S. Pat. No. 4,313,124 relating to the temperature rising rate of the heating surface.

As to the construction of the recording head and the combination of the ejection orifices, liquid passages the electrothermal transducers (linear liquid passage or right angle liquid passage), the disclosure of the U.S. Pat. Nos. 4,558,333 and 4,459,600 disclosing the construction in which the heating portion is arranged in the flexed region is incorporated in the present invention. In addition, the present invention can be also advantageously practiced using the structure disclosed in Japanese Laid-Open Application No. 123670/1984 disclosing a slit common to a plurality of electrotransducers as the discharging portions of the transducer or Japanese Laid-Open Patent Application No. 138461/1984 disclosing an opening for absorbing pressure wave of thermal energy corresponding to the discharging portion.

Further, as the recording head of the full line type having a length corresponding to the maximum recording width for a maximum usable recording medium, either the construction which satisfies its length by combination of a plurality of recording heads or the construction of one recording head may be used, and the present invention provides the corresponding effect.

In addition, the present invention is effective for a recording head of the freely exchangeable chip type which enables electrical connection to the main device or the supply of ink from the main device by being mounted on the main device, or for the case of the use of a recording head of the cartridge type provided integrally on the recording head itself.

Also, the addition of a restoration means for the recording head, a preliminary auxiliary means, or the like provided as the construction of the recording device of the present invention is preferable, because the effect of the present invention can be further stabilized. Specific examples of these may include, for the recording head, capping means, cleaning means, pressurizing or aspiration means, electrothermal transducers or another heating element or preliminary heating means according to a combination of them and it is also effective for performing a stable recording operation to perform in a preliminary mode used which performs liquid not used performing the recording operation is discharged.

Further, the present invention is extremely effective not only for a recording mode only for recording in a primary stream color such as black or the like, but is also effective in a device equipped with at least one of plural different colors or full-color by color mixing, whether the recording head may be either integrally constructed or combined in plural number.

In the embodiment of the present invention described in the foregoing, liquid ink is used. However, the present invention is applicable to ink which is solid or softened in the room temperature, since in the ink jet recording apparatus described above, the ink is heated to and maintained at a temperature not less than 30 degrees and not more than 70 degrees to provide stabilized ink viscosity so as to place it in a stabilized ejection region. Therefore, the present invention is applicable to any ink if it is in liquid state when the recording signal is applied. In addition, the present invention is applicable to the ink liquefied by application of the thermal energy, even if it starts to solidify at the time reaching the recording material, wherein the temperature rise by the thermal energy is positively prevented by causing the energy to be consumed for the phase change from the solid state to the liquid state of the ink, or wherein the ink may be such that it is solidified to prevent evaporation. In these cases, the ink may be retained in the form of liquid or solid material in recess or through holes of a porous sheet, which the electrothermal transducers. In this embodiment, the present invention is most advantageous when the above-described film boiling is used.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording head substrate comprising:

a supporting member;

a plurality of electrothermal transducers, on said supporting member, having heat generating resistors and electrodes electrically connected to said heat generating resistors, said heat generating resistors being arranged in an array; and identification marks for facilitating identification of said electrothermal transducers, wherein said identification marks are comprised of elements of the same material as said heat generating resistors and formed at the same time as a formation process of said heat generating resistors and elements of the same material as said electrodes and formed at the same time as a formation process of said electrodes, and wherein sets of said identification marks are provided for respective groups of heat generating resistors, said groups comprising equal numbers of heat generating resistors, each set of marks comprising dots representing a binary number.

2. A substrate according to claim 1, wherein the dots are provided on a layer of the electrodes disposed in the form of islands on a layer of said heat generating resistors.

3. A substrate according to claim 2, wherein the layer of said electrodes and the layer of said heat generating resistors have different light refractive indexes.

4. An ink jet recording head comprising:

a plurality of ink ejection outlets and corresponding ink passages;

a supporting member;

a plurality of electrothermal transducers provided on said supporting member and including heat generating resistors and electrodes electrically connected to said heat generating resistors, said heat generating resistors being arranged in an array; and identification marks for facilitating identification of said electrothermal transducers, wherein said identification marks are comprised of elements of the same material as said heat generating resistors and formed at the same time as a formation process of said heat generating resistors and elements of the same material as said electrodes and formed at the same time as a formation process of said electrodes, and wherein sets of said identification marks are provided for respective groups of heat generating resistors, said groups comprising equal numbers of heat generating resistors, each set of marks comprising dots representing a binary number, and said marks are disposed on or adjacent portions of said substrate defining portions of said ink passages.

5. A recording head according to claim 4, wherein said recording head is a full-line type head and wherein a plurality of said ink ejection outlets are disposed over an entire recording width of said head.

6. A recording head according to claim 4, wherein the dots are provided by a layer of said electrodes disposed in the form of islands on a layer of said heat generating resistors.

7. A recording head according to claim 6, wherein said layer of said electrodes and said layer of said heat generating resistors have different light refractive indexes.

8. A recording head according to claim 4, wherein said plurality of ejection outlets are associated with said electrothermal transducers to eject ink therethrough; and additional marks are provided on an ejection side surface of said head in which said plurality of ejection outlets are formed, said additional marks being provided for each predetermined number of ejection outlets and being made of the same material and by the same manufacturing process as said ejection side surface.

9. A recording head according to claim 4, wherein the material forming a member defining a portion of said ink passages and a top plate is substantially transparent.

10. An ink jet recording head comprising:

an element having a plurality of ejection outlets formed on an ejection side surface of said element for ejecting ink therethrough; and a plurality of marks on said ejection side surface of said element in which said plurality of ejection outlets are formed, said plurality of marks being provided for each predetermined number of ejection outlets and being in the form of three-dimensional configurations which are formed of the same material as said ejection side surface of said element, at the same time as a formation of said ejection side surface.

11. A recording head according to claim 10, wherein said recording head is a full-like type head and wherein said plurality of ink ejection outlets are disposed over an entire recording width of said head.

12. A recording head according to claim 10, wherein said element has a plurality of ink passages communicating with said plurality of ejection outlets and wherein said head further comprises a plurality of energy generating members communicating with said plurality of ink passages for ejecting ink through the ejection outlets.

13. A recording head according to claim 12, wherein said energy generating members comprises electrothermal transducers generating thermal energy.

14. A recording head according to claim 12, wherein said energy generating members comprises piezoelectric elements.

15. A recording head according to claim 10, wherein said element comprises a photosensitive resin.

16. An ink jet recording apparatus comprising:

an ink jet recording head including a supporting member; a plurality of ink ejection outlets and corresponding ink passages; a plurality of electrothermal transducers provided on said supporting member and having heat generating resistors and electrodes electrically connected to said heat generating resistors, said heat generating resistors being arranged in an array; and identification marks for facilitating identification of said electrothermal transducers, wherein said identification marks are comprised of elements of the same material as said heat generating resistors and formed at the same time as a formation process of said heat generating resistors and elements of the same material as said electrodes and formed at the same time as a formation process of said electrodes, and wherein sets of said identification marks are provided for respective groups of heat generating resistors, said groups comprising equal numbers of heat generating resistors, each set of marks comprising dots representing a binary number, and said marks are disposed on or adjacent portions of said substrate defining portions of said ink passages; wherein ink is ejected through said plurality of ink ejection outlets using thermal energy produced by heat generating portions of said heat generating resistors; and feeding means for feeding a recording material which receives the ink from the ejection outlets provided for the respective electrothermal transducers.

17. An ink jet recording apparatus according to claim 16, wherein the material forming a member defining a portion of said ink passages and a top plate is substantially transparent.

18. An ink jet apparatus, comprising:

an ink jet recording head including an element having a plurality of ejection outlets formed in an ejection side surface of said element for ejecting ink therethrough; and a plurality of marks on said ejection side surface of said element, said plurality of marks being provided for each predetermined number of ejection outlets and being in the form of three-dimensional configurations and being formed of the same material as said ejection side surface of said element, at the same time as a formation of said ejection side surface; and feeding means for feeding a recording material which receives the ink from said plurality of ejection outlets provided for respective electrothermal transducers.

* * * * *

UNITED STATES PATENT AND TRADEMARK OFFICE

CERTIFICATE OF CORRECTION

PATENT NO. : 5,237,343 Page 1 of 3

DATED : August 17, 1993

INVENTOR(S) : Torachika OSADA

It is certified that error appears in the above-indentified patent and that said Letters Patent is hereby corrected as shown below:

On the title page: Item

[56] REFERENCES CITED - FOREIGN PATENT DOCUMENTS:

After "59-138461 8/1984 Japan ." insert
--37 02 643 8/1987 Fed. Rep. of Germany
0 066 835 6/1982 European Pat. Off.--.

COLUMN 1:

Line 20, "correspond" should read --corresponding--;
Line 33, "transducer)" should read --transducers)--;
Line 46, "numericals" should read --numerals--;
Line 58, "numerical," should read --numeral,--.

COLUMN 4:

Line 4, "includes" should read --include--;
Line 30, "represents" should read --represent--;
Line 57, "simply" should read --by simply--.

COLUMN 5:

Line 10, "transducer" should read --transducers--.

UNITED STATES PATENT AND TRADEMARK OFFICE

CERTIFICATE OF CORRECTION

PATENT NO. : 5,237,343

DATED : August 17, 1993

INVENTOR(S) : Torachika OSADA

It is certified that error appears in the above-indentified patent and that said Letters Patent is hereby corrected as shown below:

COLUMN 6:

Line 33, "supply Grooves" should read --supply ink to the recording head from an ink container. Grooves--;
Line 36, "mark," should read --marks,--;
Line 43, "described" should read --described.--;
Line 60, "pattern" should read --a pattern--.

COLUMN 7:

Line 1, "b" should read --by--;
Line 38, "is" should read --are--;
Line 43, "cut," should read --cut and--;
Line 64, "a" should read --an--.

COLUMN 8:

Line 15, "transducer" should read --transducers--;
Line 34, "thermal electrotransducers." should read --electrothermal transducers.--.

COLUMN 9:

Line 44, "U.S. Nos." should read --U.S. Pat. Nos.--.

UNITED STATES PATENT AND TRADEMARK OFFICE

CERTIFICATE OF CORRECTION

PATENT NO. : 5,237,343 Page 3 of 3

DATED : August 17, 1993

INVENTOR(S) : Torachika OSADA

It is certified that error appears in the above-indentified patent and that said Letters Patent is hereby corrected as shown below:

COLUMN 10:

Line 21, "performs" should be deleted;
Line 24, "only for recording" should read --for recording only--;
Line 42, "time" should read --time of--;
Line 49, "recess" should read --recesses--; and "through holes" should read --through-holes--;
Line 50, "which the" should read --which faces the--.

COLUMN 12:

Line 27, "comprises" should read --comprise--;
Line 30, "comprises" should read --comprise--.

Signed and Sealed this

Twenty-sixth Day of July, 1994

Bruce Lehman

*Attest:*

BRUCE LEHMAN

*Attesting Officer*

*Commissioner of Patents and Trademarks*